US008622168B2

(12) United States Patent
Matsushima et al.

(10) Patent No.: US 8,622,168 B2
(45) Date of Patent: Jan. 7, 2014

(54) MOTORCYCLE EXHAUST SYSTEM STRUCTURE INCLUDING A RESONATOR PROVIDED TO AN EXHAUST PIPE

(75) Inventors: Satoshi Matsushima, Saitama (JP); Yusuke Inoue, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 81 days.

(21) Appl. No.: 13/355,765

(22) Filed: Jan. 23, 2012

(65) Prior Publication Data

US 2012/0186905 A1 Jul. 26, 2012

(30) Foreign Application Priority Data

Jan. 26, 2011 (JP) ..... 2011-014076

(51) Int. Cl.
*F01N 1/02* (2006.01)
*F01N 1/10* (2006.01)
*F01N 13/08* (2010.01)

(52) U.S. Cl.
USPC ..... 181/250; 181/227; 181/228; 181/249; 181/252

(58) Field of Classification Search
USPC ..... 181/250, 249, 252, 228
See application file for complete search history.

(56) References Cited

U.S. PATENT DOCUMENTS

| | | | | |
|---|---|---|---|---|
| 4,529,060 | A * | 7/1985 | Komauer et al. | 181/227 |
| 7,434,656 | B2 * | 10/2008 | Yasuda et al. | 181/227 |
| 7,510,050 | B2 * | 3/2009 | Emler | 181/249 |
| 7,997,382 | B2 * | 8/2011 | Hagiwara | 181/249 |
| 8,127,887 | B2 * | 3/2012 | Terashima et al. | 181/251 |
| 2007/0193812 | A1 * | 8/2007 | Adachi et al. | 180/309 |
| 2009/0139796 | A1 * | 6/2009 | Hagiwara | 181/252 |
| 2009/0272601 | A1 * | 11/2009 | Hagiwara | 181/249 |
| 2010/0213000 | A1 * | 8/2010 | Inoue | 181/252 |
| 2011/0147118 | A1 * | 6/2011 | Inoue et al. | 181/252 |
| 2011/0186373 | A1 * | 8/2011 | Mori et al. | 180/219 |
| 2012/0031698 | A1 * | 2/2012 | Inoue et al. | 181/252 |

FOREIGN PATENT DOCUMENTS

JP 2009-287548 A 12/2009

* cited by examiner

*Primary Examiner* — David Warren
*Assistant Examiner* — Christina Russell
(74) *Attorney, Agent, or Firm* — Carrier Blackman & Associates, P.C.; William D. Blackman; Michael J. McCandlish

(57) ABSTRACT

In a motorcycle in which an internal combustion engine including a crankcase, a cylinder, and a cylinder head is attached to a vehicle body frame, an exhaust system includes an exhaust pipe connected to the cylinder head, and a resonator having a communication hole in communication with an inside of the exhaust pipe. The exhaust pipe is curved after being extended forward from the cylinder head and is then extended rearward in such a manner as to pass by a lateral side of the cylinder above the crankcase, while the resonator is arranged in a space between the exhaust pipe and the cylinder, and is joined to a side surface of the exhaust pipe facing inwardly of the motorcycle.

13 Claims, 12 Drawing Sheets

MOTORCYCLE EXHAUST SYSTEM STRUCTURE INCLUDING A RESONATOR PROVIDED TO AN EXHAUST PIPE

TECHNICAL FIELD

The present invention relates to a motorcycle exhaust system structure in which a resonator is provided to an exhaust pipe.

BACKGROUND ART

Some motorcycles include a resonator provided to an exhaust pipe. See, for example, Japanese Patent Application Publication No. 2009-287548 (hereinafter JP 2009-287548) which discloses such a motorcycle including a resonator of a double pipe structure provided to an exhaust pipe.

As shown in JP 2009-287548, when a resonator is provided as a double pipe structure, the shaping of the resonator is complicated because its layout needs to match the shapes of the exhaust pipe and the internal combustion engine. Accordingly, the exterior of the resonator is complicated as well in this known motorcycle. Moreover, the attachment structure of an exhaust protector is also subject to the constraints of the shape of the resonator and is thus complicated in shape and larger in size.

SUMMARY OF THE INVENTION

The present invention has been made in consideration of the aforementioned circumstances and aims to provide a motorcycle exhaust system structure capable of improving the exterior arrangement of a vehicle by compactly arranging a resonator in the vehicle.

For the purpose of solving the above-mentioned problems, according to a first aspect of the present invention there is provided a motorcycle exhaust system structure in a motorcycle in which an internal combustion engine including a crankcase, a cylinder, and a cylinder head is attached to a vehicle body frame, the motorcycle exhaust system structure comprising: an exhaust pipe connected to the cylinder head; and a resonator having a communication hole in communication with an inside of the exhaust pipe; wherein the exhaust pipe is curved after being extended forward from the cylinder head and is then extended rearward in such a manner as to pass by a lateral side of the cylinder above the crankcase; and wherein the resonator is arranged in a space between the exhaust pipe and the cylinder, and is joined to a side surface of the exhaust pipe facing inwardly of the motorcycle.

In the motorcycle exhaust system structure according to a second aspect of the invention, in addition to the first aspect, the resonator has a flat box shape being long in a vehicle front-rear direction and a vehicle up-down direction and having a small lateral width in a vehicle width direction, and a lateral wall of the resonator directly joined to the exhaust pipe.

In the motorcycle exhaust system structure according to a third aspect of the invention, in addition to either of the first and second aspects, the resonator is formed of two components divided along a substantially vertical plane.

In the motorcycle exhaust system structure according to a fourth aspect of the invention, in addition to any of the first-third aspects, the structure further comprises an exhaust protector provided to the exhaust pipe; a lateral wall of the resonator facing the exhaust pipe is directly joined to the exhaust pipe; a supporting recessed portion which forms a space between the resonator lateral wall and an outer surface of the exhaust pipe is formed in the resonator lateral wall; the exhaust protector is placed on a side of the exhaust pipe opposite to the resonator with the exhaust pipe interposed therebetween; and the exhaust protector is supported by a band member inserted through the supporting recessed portion.

In the motorcycle exhaust system structure according to a fifth aspect of the invention, in addition to any of the first-fourth aspects, the exhaust pipe is formed by joining together a curved pipe part extending forward from the cylinder head and then curving and a rear pipe part extending rearward from the curved pipe part; a releasing recessed portion forming a space between the resonator lateral wall and an outer surface of the exhaust pipe is formed on the lateral wall of the resonator facing the exhaust pipe; and the resonator is attached to the exhaust pipe in such a manner as to straddle a joint portion of the exhaust pipe between the curved pipe part and the rear pipe part while causing the releasing recessed portion to face the joint portion.

In the motorcycle exhaust system structure according to a sixth aspect of the invention, in addition to the fourth aspect, a recessed portion is formed in a lateral wall of the resonator facing the cylinder, the recessed portion having a bottom portion facing, inside the resonator, a bottom portion of the supporting recessed portion formed on the lateral wall of the resonator facing the exhaust pipe; and a swell chamber is formed in the resonator by the recessed portion facing the cylinder and the supporting recessed portion facing the exhaust pipe.

In the motorcycle exhaust system structure according to a seventh aspect of the invention, in addition to the fifth aspect, an outer recessed portion is formed in a lateral wall of the resonator facing the cylinder, the recessed portion having a bottom portion facing a bottom portion of the releasing recessed portion formed on the lateral wall of the resonator facing the exhaust pipe on an inner side of the resonator is formed on a lateral wall of the resonator facing the cylinder; and a swell chamber is formed in the resonator by the recessed portion facing the cylinder and the releasing recessed portion facing the exhaust pipe.

In the motorcycle exhaust system structure according to an eighth aspect of the invention, in addition to any of the first-seventh aspects, the exhaust pipe linearly extends rearward after curving; and the communication hole is in communication with a portion of the exhaust pipe where the exhaust pipe becomes a linear shape after curving and which is positioned on an extension line of a curved portion of the exhaust pipe.

In the motorcycle exhaust system structure according to a ninth aspect of the invention, in addition to the first aspect, the exhaust pipe passes by the lateral side of the cylinder above the crankcase in such a manner as to come closer to the cylinder as extending rearward; in a top view, the resonator includes a front inclination portion at a front-side corner portion thereof positioned facing the cylinder, and a rear inclination portion at a rear-side corner portion thereof positioned facing the cylinder, the front inclination portion coming closer to the cylinder as extending rearward, the rear inclination portion positioned more distant from the cylinder as extending rearward; and the rear inclination portion inclines more gently than the front inclination portion and is formed longer in the rearward direction.

According to the first aspect of the invention, it is possible to improve the exterior arrangement of a vehicle by compactly arranging the resonator while effectively using the space.

According to the second aspect of the invention, it is possible to reduce the size of the exhaust system structure in the vehicle width direction by effectively using the space between the exhaust pipe and the cylinder.

According to the third aspect of the invention, it is possible to form the resonator separately between the exhaust pipe side and the internal combustion engine side while matching the portions of the resonator with the shapes of the components on the respective sides, thereby, improving the degree of freedom in design.

According to the fourth aspect of the invention, it is possible to simply install an exhaust protector without being affected by the resonator.

According to the fifth aspect of the invention, it is possible to easily attach the resonator to the exhaust pipe even in a shape where the exhaust pipe is formed of separate components.

According to either of the sixth and seventh aspects of the invention, it is possible to easily form a swell chamber in the resonator.

According to the eighth aspect of the invention, the communication hole of the resonator is in communication with the portion of the exhaust pipe which is located at a position after the exhaust pipe curves and where the exhaust flow rate is slow, so that influence on the exhaust flow due to the resonator is suppressed and thereby a desired output of the internal combustion engine can be obtained.

According to the ninth aspect of the invention, the exhaust pipe curves after extending forward, and then passes by a lateral side of the cylinder in such a manner as to come closer to the cylinder as the exhaust pipe extends rearward, and is thus positioned on an inner side of the vehicle body in a top view. Thus, although the distance between the exhaust pipe and the cylinder is reduced as the exhaust pipe extends rearward, the resonator can be compactly arranged in the vehicle by forming the resonator into a shape corresponding to the shape and arrangement of the exhaust pipe.

DETAILED DESCRIPTION INCLUDING BEST MODE FOR CARRYING OUT THE INVENTION

Figure 1:
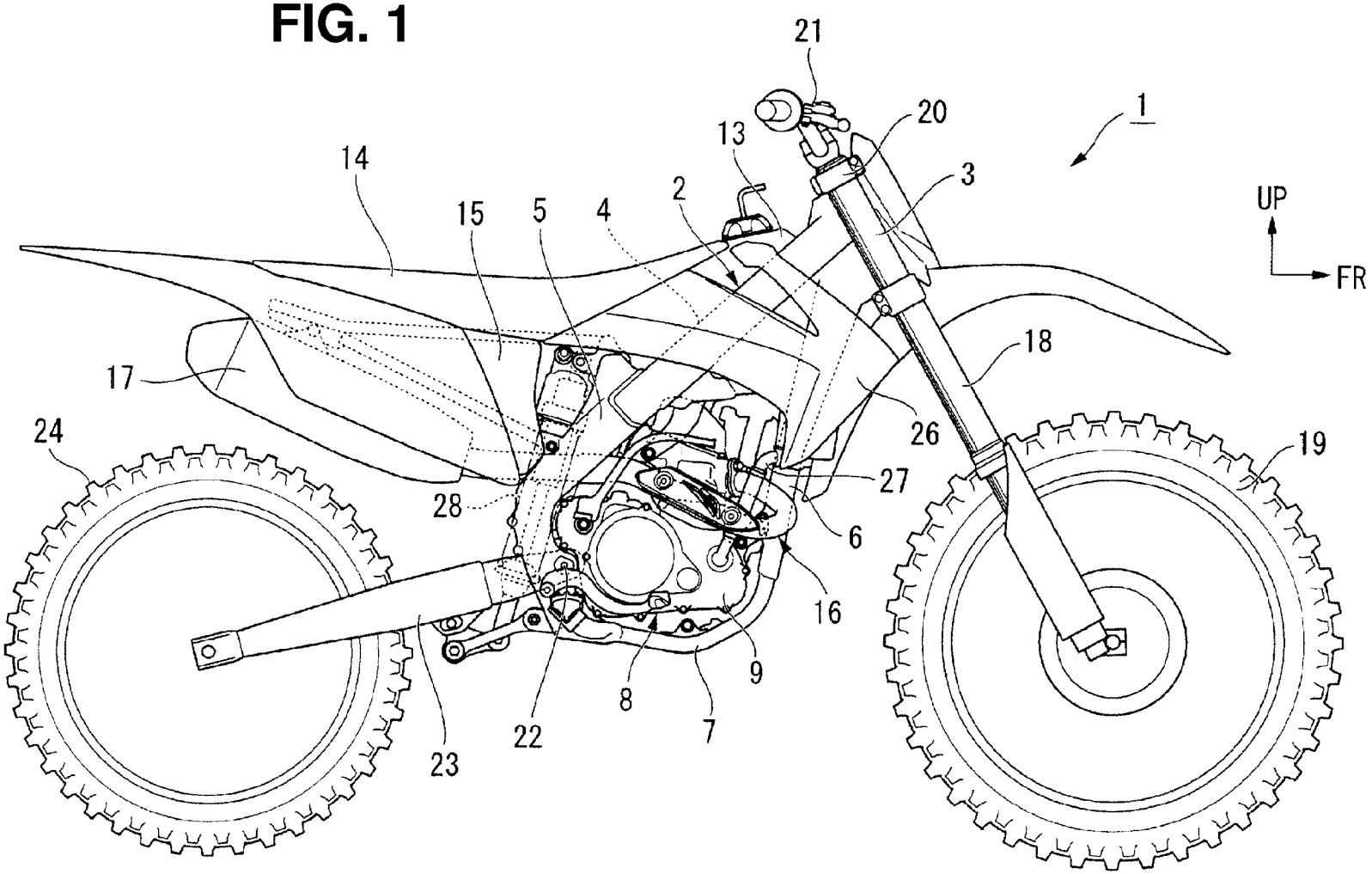
FIG. 1 is a right-side view of a motorcycle to which an exhaust system structure according to an embodiment of the present invention is applied.

Hereinafter, a description will be given of an embodiment of the present invention on the basis of the drawings. Note that, in the drawings used in the following description, an arrow FR indicates a forward direction of a vehicle, an arrow UP indicates an upward direction of the vehicle, and an arrow RH indicates a rightward direction of the vehicle.

Figure 2:
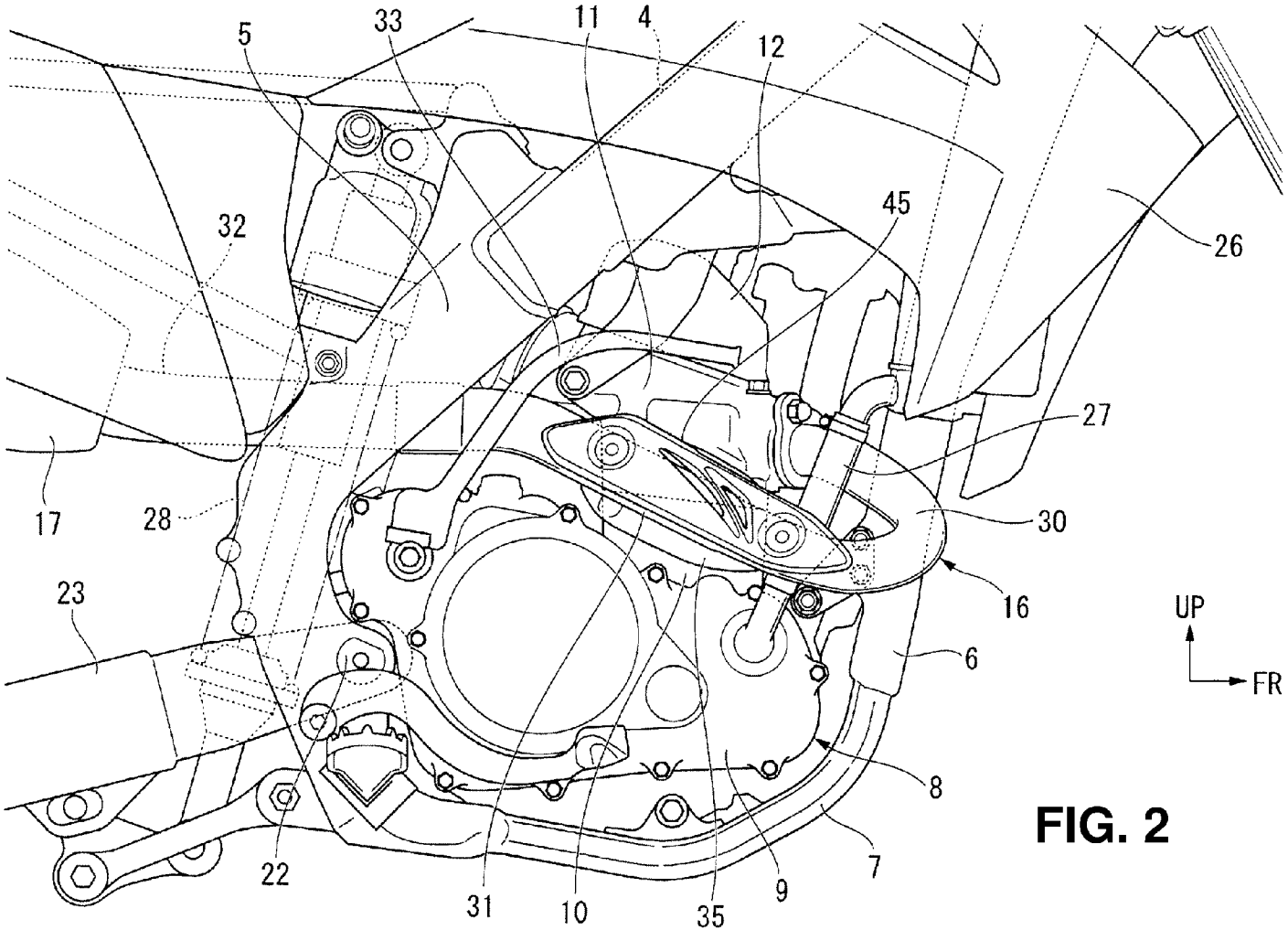
FIG. 2 is a right-side view of the periphery of an internal combustion engine of the motorcycle in FIG. 1.

FIG. 1 shows an off-road motorcycle 1, and a vehicle body frame 2 of the motorcycle 1 includes a head pipe 3, a main frame 4, paired left and right center frames 5, 5, a down frame 6, and paired left and right lower frames 7, 7. The head pipe and frames are connected to one another in a loop shape and support an internal combustion engine 8, which is attached to the inner side of the loop. As shown in FIG. 2, the internal combustion engine 8 includes a crankcase 9, a cylinder 10, a cylinder head 11 and a head cover 12.

Figure 3:
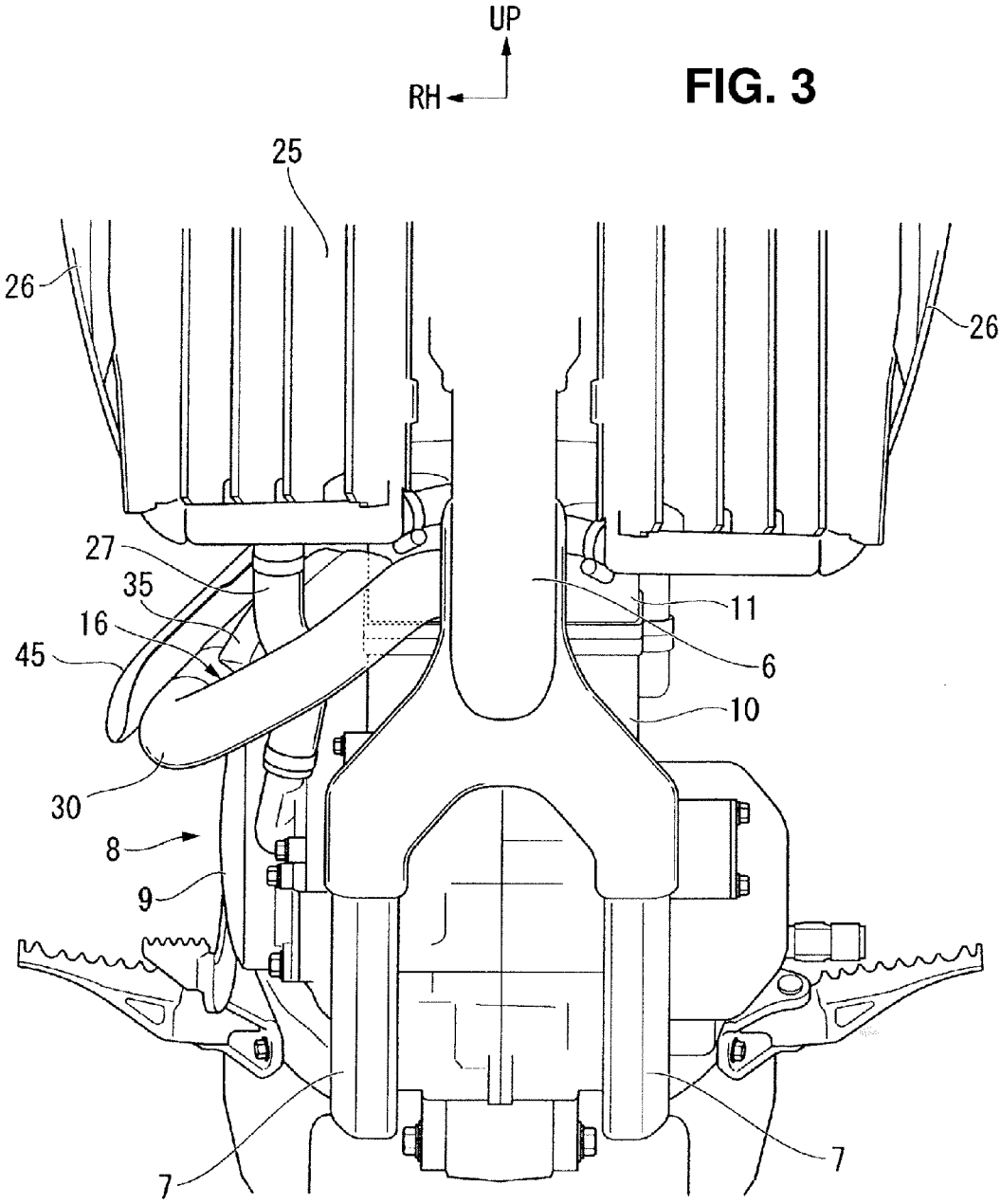
FIG. 3 is a front view of the periphery of the internal combustion engine of the motorcycle in FIG. 1.

The main frame 4 extends above the internal combustion engine 8 linearly at a center position of the vehicle body in an obliquely downward direction to the rear. The center frames 5, 5 are connected to the main frame 4 above the crankcase 9 and then are curved downward in such a manner as to extend around the rear of the crankcase 9. The down frame 6 extends below in front of the internal combustion engine 8 linearly at a center position of the vehicle body in an obliquely downward direction and then connected to front end portions of the paired left and right lower frames 7, 7 at a lower end portion of the down frame 6 as shown in FIG. 3. The lower frames 7, 7 extends downward substantially linearly while curving below the internal combustion engine 8 from a front side lower portion of the internal combustion engine 8 and then are connected to lower end portions of the center frames 5, 5 at rear end portions of the lower frames 7, 7, respectively.

The internal combustion engine 8 is a water-cooled, four-cycle engine, and the cylinder 10 is provided to a front portion of the crankcase 9 in a state of standing in an upright position where its cylinder axis line is substantially vertical. The cylinder head 11 is provided on a top portion of the cylinder 10, and the head cover 12 covers a top portion of the cylinder head 11. The internal combustion engine 8 is reduced in size in a front-rear direction by causing the cylinder 10 to stand in the upright position. Thus, the internal combustion engine 8 is formed appropriately for an off-road vehicle.

A fuel tank 13 is supported by the main frame 4 above the internal combustion engine 8, and a seat 14 is placed right behind the fuel tank 13. An air cleaner whose illustration is omitted is provided on an inner side of a side cover 15, which is placed under the seat 14. Thus, air is taken from the air cleaner to the cylinder head 11 in a direction from the rear of the vehicle body. An exhaust pipe 16 is connected to the front of the cylinder head 11. The exhaust pipe 16 extends forward from the cylinder head and then turns rearward and extends rightward around the cylinder 10. A muffler 17 is connected to a rear end of the exhaust pipe 16.

The head pipe 3 supports paired left and right front forks 18, 18, and lower end portions of the front forks 18, 18 rotatably support a front wheel 19. A top bridge 20 is installed between upper portions of the front forks 18, 18, and a steering handlebar 21 is fixed to the top bridge 20. A pivot shaft 22 is supported by lower end portions of the center frames 5, 5 in a state of extending in a vehicle width direction and thereby swingably supports a rear swing arm 23. Rear end portions of the swing arm 23 support a rear wheel 24. A rear cushion unit 28 is installed between the swing arm 23 and the center frames 5, 5.

As shown in FIG. 3, a radiator 25 is supported by the down frame 6. Both lateral sides of the radiator 25 are covered by a front cover 26, which is positioned in front of the side cover 15. A water hose 27 is connected to a right side lower portion of the radiator 25 and extends downward, and its lower end is connected to a right side lateral portion of the crankcase 9. The exhaust pipe 16 extends forward from the cylinder head 11 and curves while passing by in front of the water hose 27.

As shown in FIG. 2, the exhaust pipe 16 is formed by joining (welding) together a curved pipe part 30, a rear pipe part 31 and a rear extension pipe part 32. The curved pipe part 30 extends forward from the cylinder head 11 and then curves. The rear pipe part 31 extends rearward from the curved pipe part 30. The rear extension pipe part 32 extends rearward from the rear pipe part 31. The curved pipe part 30 and the rear pipe part 31 are joined together on a right side of the cylinder 10 as denoted by reference numeral L1 in FIG. 4. The rear pipe part 31 extends rearward above the crankcase 9 in such a manner as to pass by a lateral side of the cylinder 10 and then is joined to the rear extension pipe part 32 as shown in FIG. 2 and FIG. 4.

To put it specifically, the curved pipe part 30 curves through substantially 180 degrees after extending forward and then downward in a right oblique direction and opens its rear end rearward in such a manner as to direct its rear end to the center in the vehicle width direction from an outer side in the vehicle width direction at a position on the right side of the cylinder 10. The rear pipe part 31 extends upward in a rear oblique direction from the rear end of the curved pipe part 30 at a gentle angle in a side view. In addition, referring to FIG. 4, the rear pipe part 31 extends rearward in a direction to the center in the vehicle width direction from the front in a top view. To put it differently, the rear pipe part 31 passes by a lateral side of the cylinder 10 above the crankcase 9 in such a manner as to come closer to the cylinder 10 as the rear pipe part 31 extends rearward in a top view. Moreover, the rear pipe part 31 curves above a rear portion of the crankcase 9, then extends rearward on an inner side of the right side center frame 5 in the vehicle width direction and then opens its rear end in a straight rearward direction.

The rear extension pipe part 32 extends from the rear end of the rear pipe part 31 in a straight rearward direction, and the aforementioned muffler 17 is connected to a rear end of the rear extension pipe part 32. Note that, as shown in FIG. 4, a relatively wide space Si is formed above the crankcase 9 by connecting the rear pipe part 31 to the rear end of the curved pipe part 30 to extend rearward toward the center in the vehicle width direction from the front and then to pass by the inner side on the right side center frame 5 in the vehicle width direction. A kick pedal 33, which extends upward from a rear end portion of the crankcase 9, is arranged in this space S1.

Figure 4:
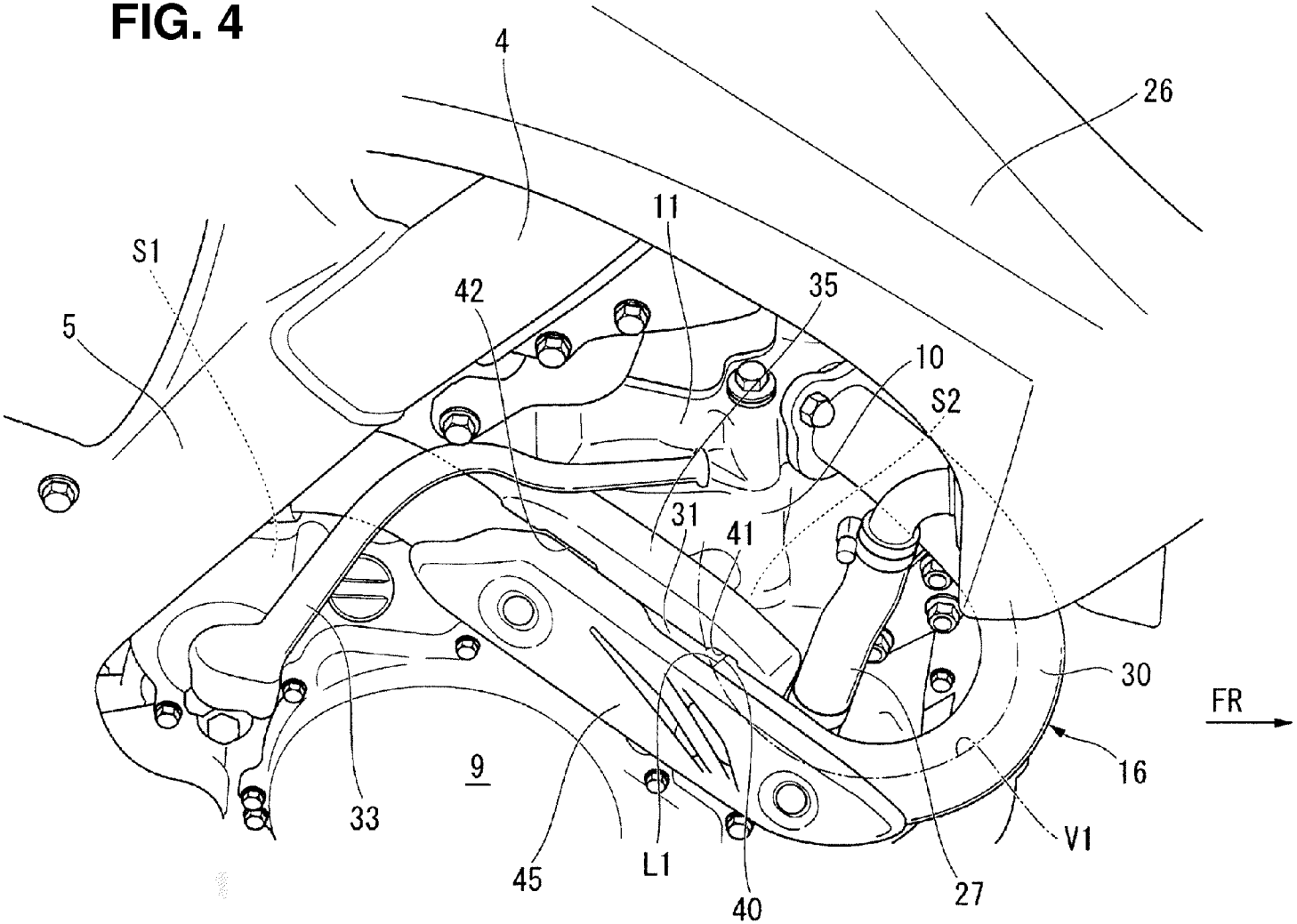
FIG. 4 is a perspective view of the periphery of the internal combustion engine of the motorcycle in FIG. 1.
Figure 5:
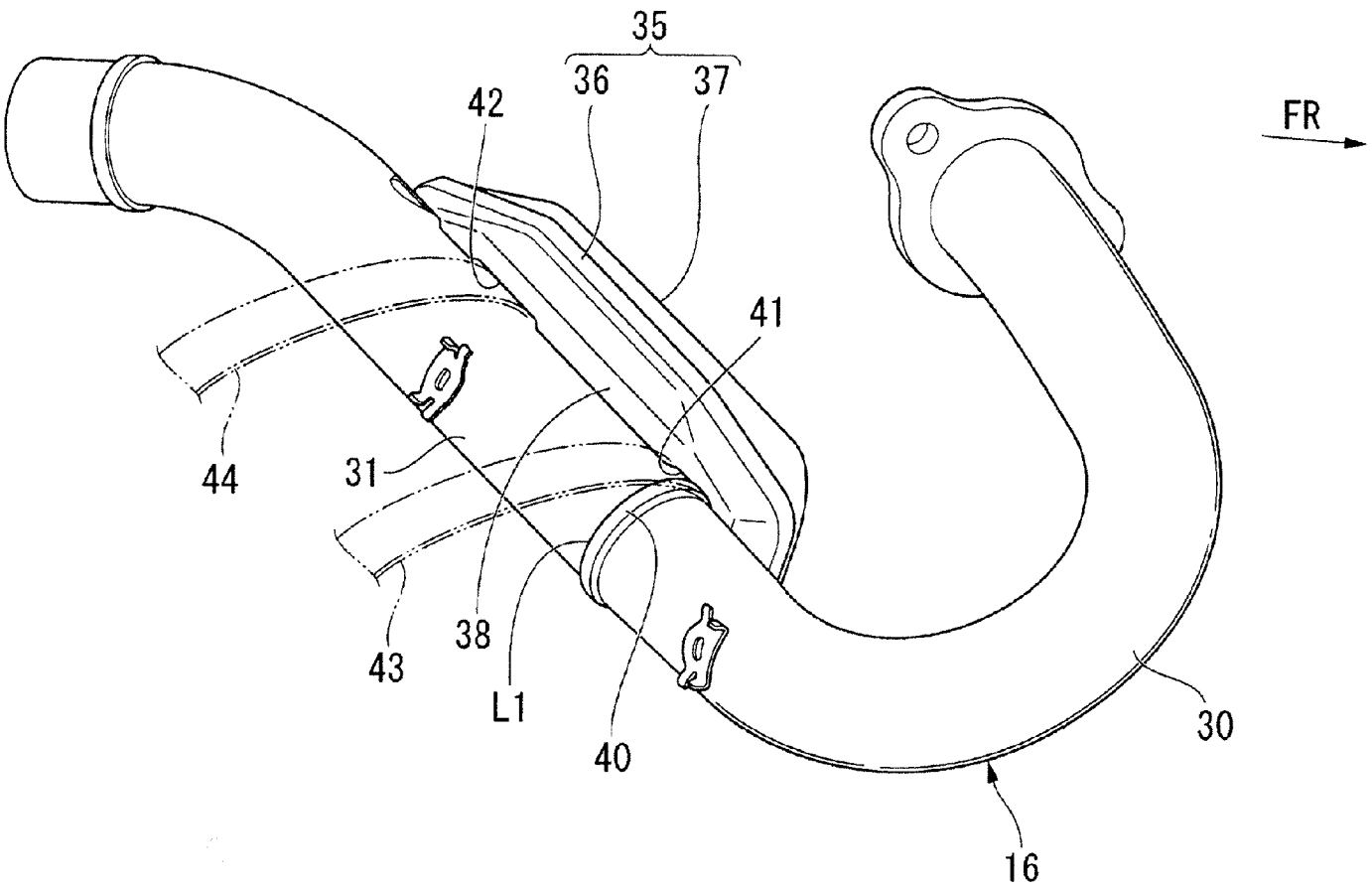
FIG. 5 is an outer perspective view of an exhaust pipe connected to the internal combustion engine of the motorcycle in FIG. 1, and a resonator.
Figure 6:
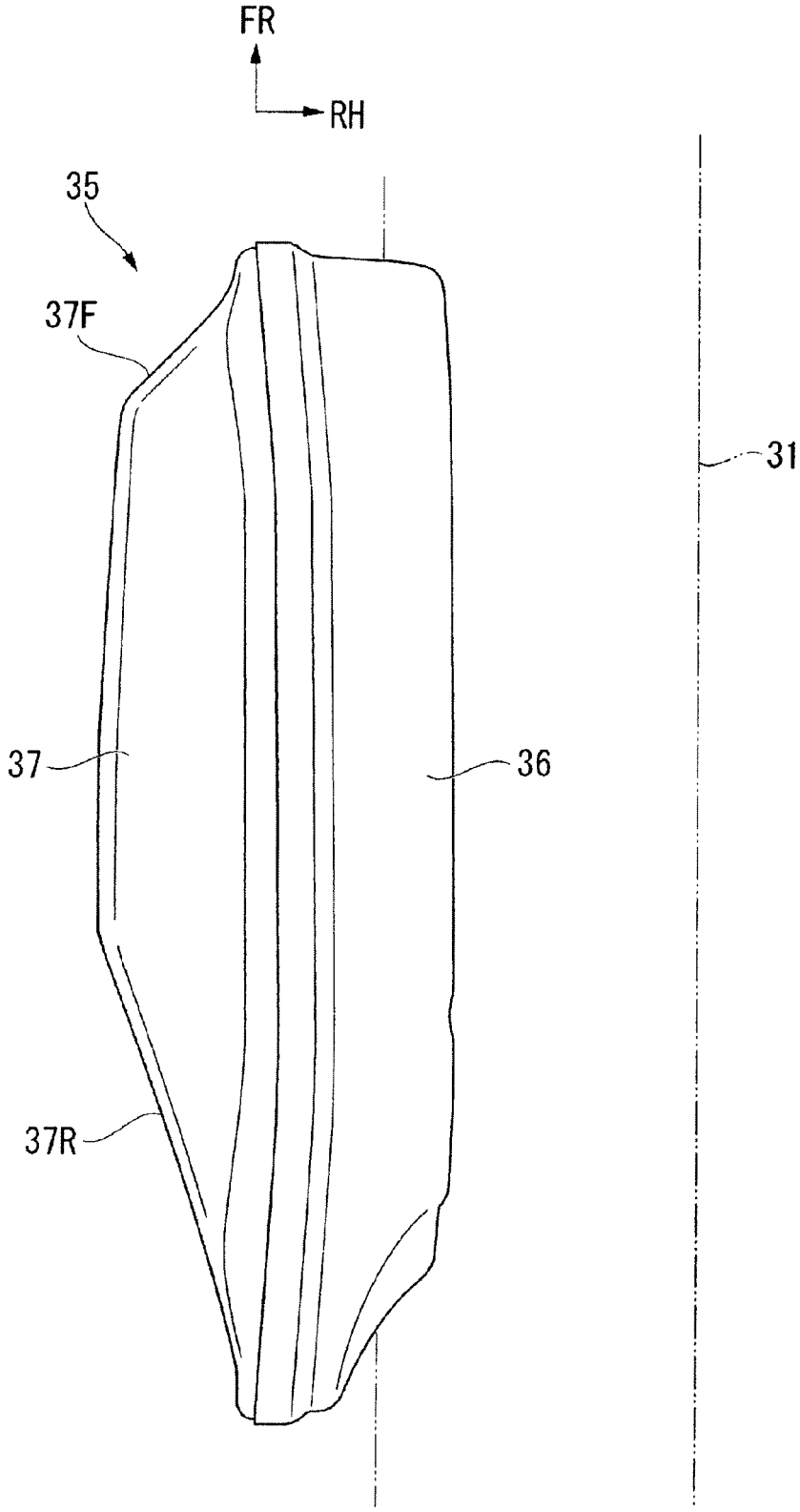
FIG. 6 is a top view of the resonator according to the present embodiment.

As shown in FIG. 4, a space S2 is formed between the rear pipe part 31 and the cylinder 10, and a resonator 35, which is in communication with the rear pipe part 31 and is joined (welded) to the rear pipe part 31, is arranged in this space S2. Referring to FIG. 5 and FIG. 6, the resonator 35 is formed in a flat box shape that is long in a vehicle front-rear direction and also in a vehicle up-down direction and has a small lateral width in the vehicle width direction. The resonator 35 is formed by joining (welding) together an outer half body 36, which is positioned facing the rear pipe part 31, and an inner half body 37, which is positioned facing the cylinder 10. Thus, resonator 35 forms an enclosed space.

Figure 7:
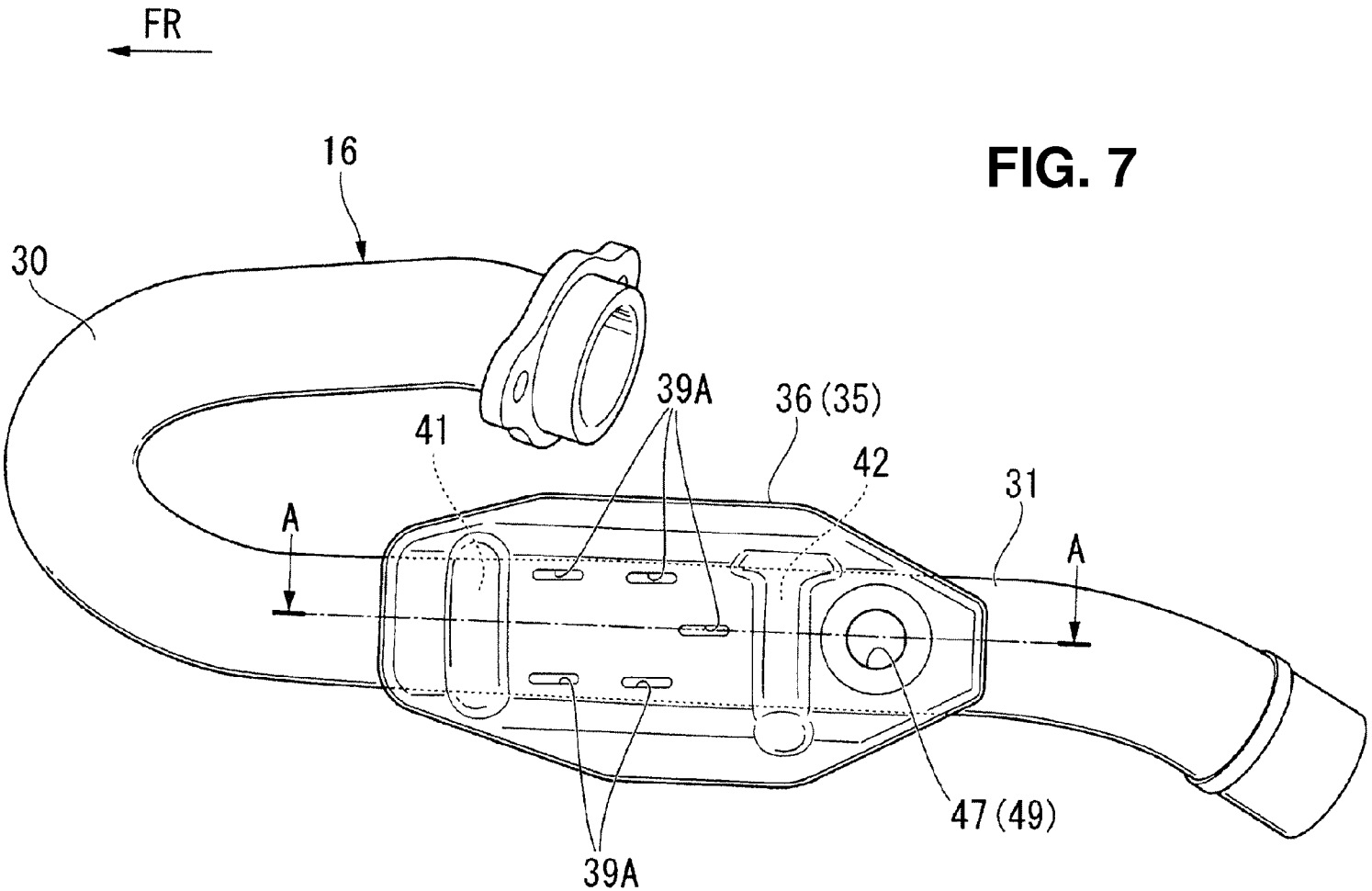
FIG. 7 is an inner perspective view of the exhaust pipe connected to the internal combustion engine of the motorcycle in FIG. 1, and the resonator.

FIG. 7 shows the exhaust pipe 16 and the resonator 35 in a state where the outer half body 36 is removed. The outer half body 36 is formed in an elongated shape extending along the longitudinal direction of the rear pipe part 31 and exhibits a substantially octagonal shape in which its front portion and rear portion taper off along the extension direction of the rear pipe part 31. Meanwhile, the inner half body 37 exhibits a substantially octagonal shape in an elongated shape extending along the longitudinal direction of the rear pipe part 31 as in the case of the outer half body 36. The resonator 35 formed by joining together the inner half body 37 and the outer half body 36 is thus formed in a polyhedral shape. Division surfaces of the inner half body 37 and the outer half body 36 are set in a vertical direction and are joined (welded) together. To put it specifically, the resonator 35 is formed of two vertically divided components or two components divided along a substantially vertical plane.

Figure 8:
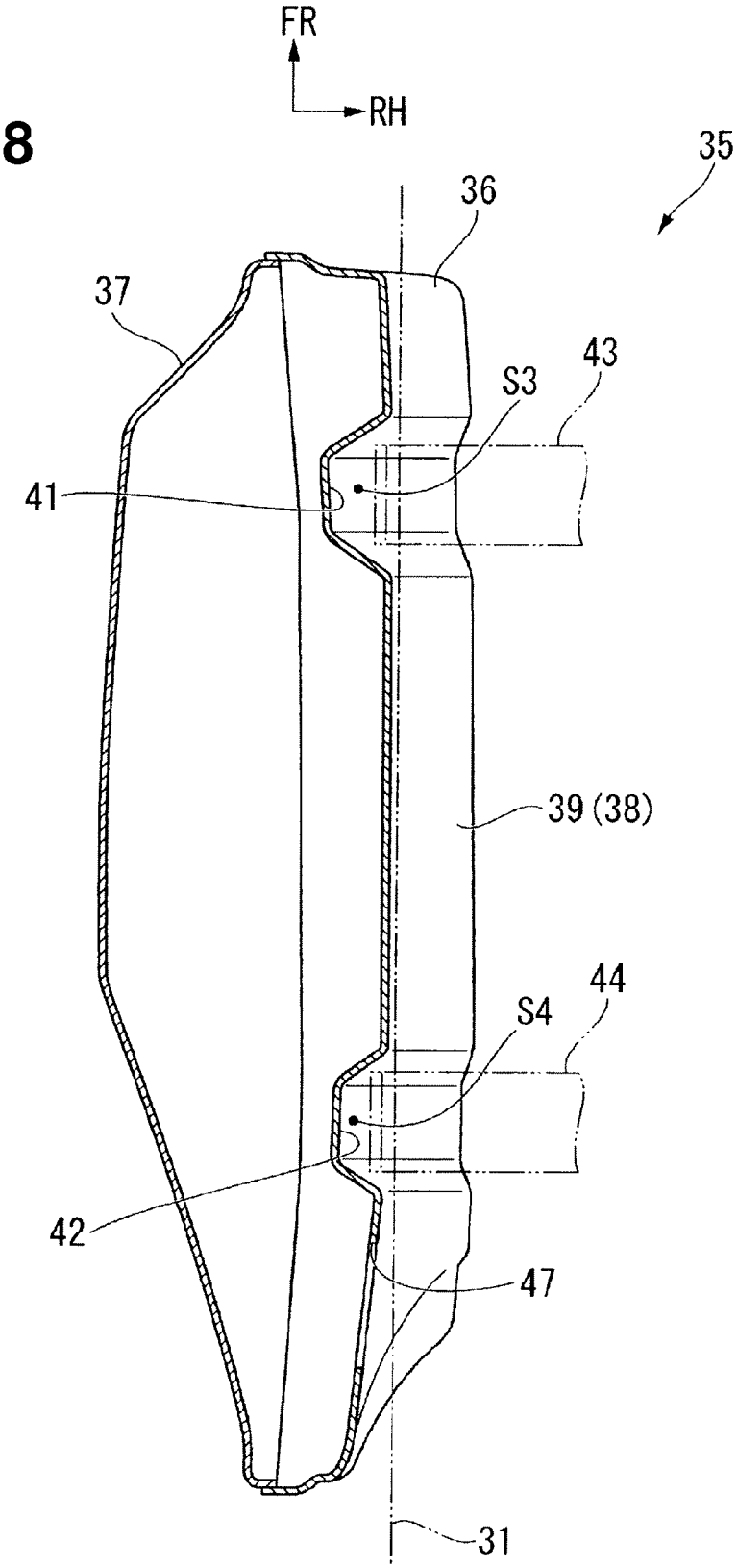
FIG. 8 is a cross-sectional view taken along the line A-A in FIG. 7, which shows the resonator according to the present embodiment.

FIG. 8 shows a cross section of the resonator 35, taken along the line A-A in FIG. 7. Referring to FIG. 5 and FIG. 8, a contact surface 39 having a cross-sectionally arc shape to be brought into contact along a curved surface of the rear pipe part 31 is formed on an outer lateral wall 38, which is located on the outer half body 36 facing the exhaust pipe 16. The outer half body 36 is joined (welded) in a state where the contact surface 39 is brought into contact with the rear pipe part 31. As shown in FIG. 7, multiple (five in this example) welding holes 39A . . . are provided in a substantially center region of the outer lateral wall 38 of the outer half body 36 while penetrating through the outer lateral wall 38. The outer half body 36 is directly joined to the rear pipe part 31 while being welded thereto by causing molten metal to flow through the welding holes 39A.

As shown in FIG. 4 and FIG. 5, the outer half body 36 is joined to the rear pipe part 31 in such a manner as to straddle a joint portion 40 between the curved pipe part 30 and the rear pipe part 31. Then, as shown in FIG. 8, a first recessed portion 41, which forms a space S3 between the outer lateral wall 38 and an outer surface of the rear pipe part 31, is formed on the outer lateral wall 38 of the outer half body 36. The first recessed portion 41 is positioned in such a manner as to face the joint portion 40, thereby, avoiding interference between the joint portion 40 and the outer lateral wall 38.

Moreover, a second recessed portion 42, which forms a space S4 between the outer lateral wall 38 and the outer surface of the outer half body 36, is formed on the outer lateral wall 38 facing the rear pipe part 31 at a position rearwardly of the first recessed portion 41. Here, referring to FIG. 5, band members 43, 44 are inserted through the first recessed portion 41 and the second recessed portion 42 (the spaces S3 and S4), respectively. In the present embodiment, the band members 43, 44 support an exhaust protector 45, which is shown in FIG. 2, FIG. 4 and the like and is placed on an outer side in the vehicle width direction. The outer side is a side opposite to the resonator 35 on the rear pipe part 31.

Referring to FIG. 7, a communication hole 47 is formed in the outer lateral wall 38 of the outer half body 36, and the resonator 35 is in communication with the exhaust pipe 16 through the communication hole 47. The communication hole 47 is formed near the rear of the second recessed portion 42, and a through hole 49 corresponding to the communication hole 47 is formed in the rear pipe part 31. Thus, exhaust is introduced into the resonator 35 through the communication hole 47 and is returned to the exhaust pipe 16 from the resonator 35 after passing through the communication hole 47 and then is discharged in the present embodiment.

Figure 9:
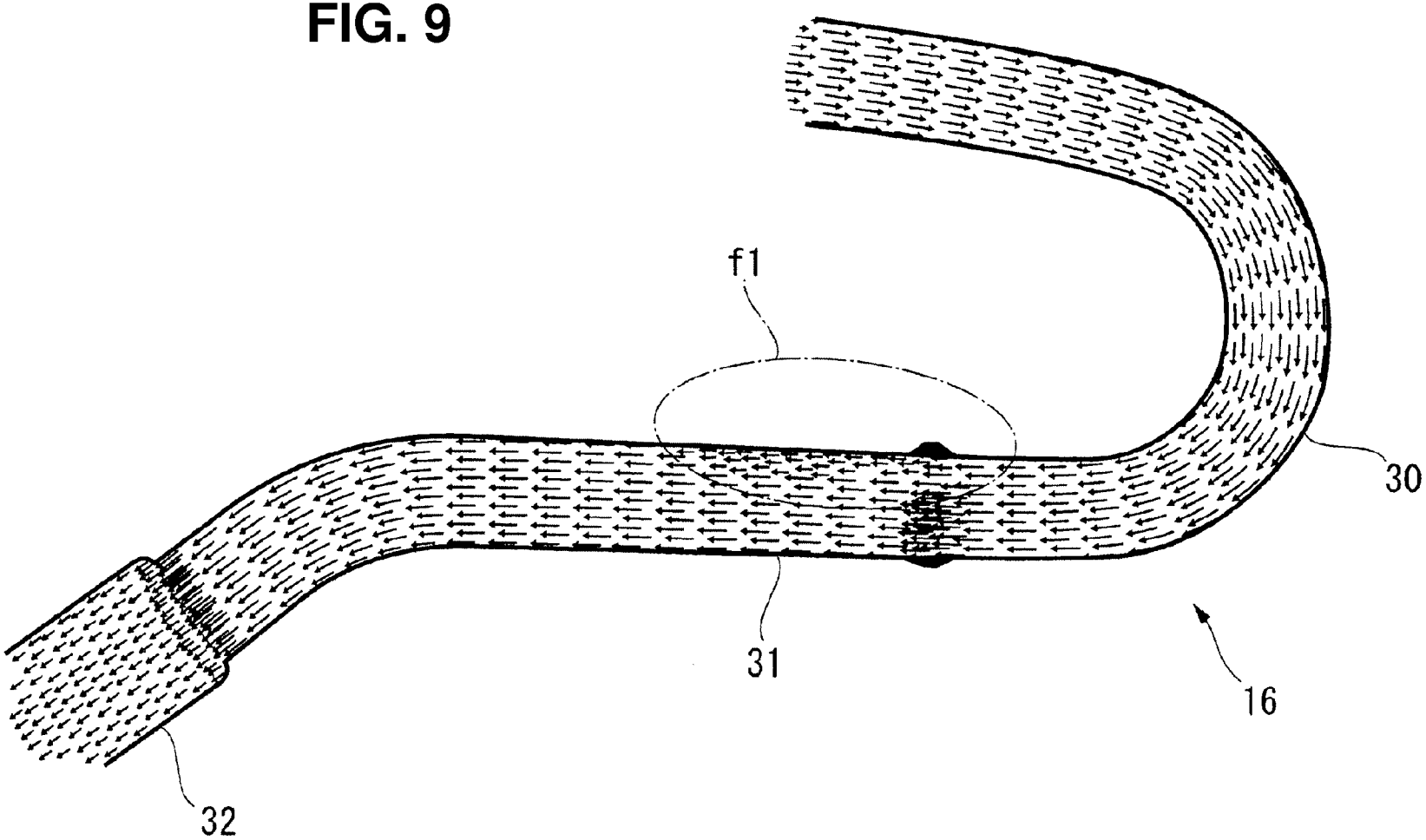
FIG. 9 is a diagram schematically showing an exhaust flow rate in the exhaust pipe of a case where no resonator according to the present embodiment is provided to the exhaust pipe.
Figure 10:
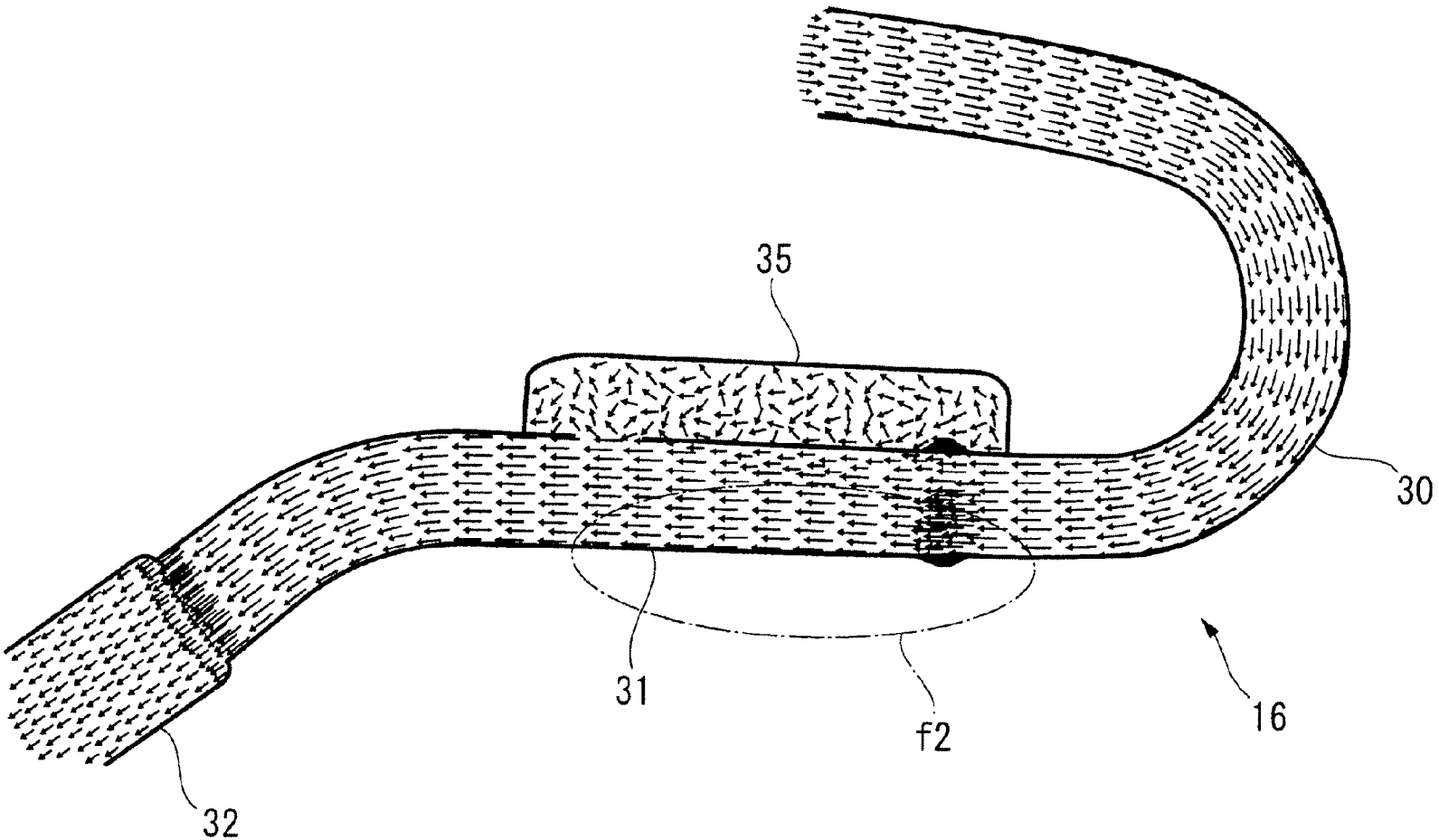
FIG. 10 is a diagram schematically showing an exhaust flow rate in the exhaust pipe provided with the resonator according to the present embodiment.

The communication hole 47 is provided in the resonator 35 in such a manner as to be in communication with a portion (rear pipe part 31) of the exhaust pipe 16 where the exhaust pipe 16 becomes a linear shape after curving and which is positioned on a virtual extension line V1 of the curved portion (curved pipe part 30) of the exhaust pipe 16 with reference to FIG. 4. To put it another way, the communication hole 47 is provided on an inner side path of the curved line of the curved pipe part 30 in the rear pipe part 31. Here, FIG. 9 is a diagram schematically showing a result of analysis of an exhaust flow rate in the exhaust pipe 16 of a case where the resonator 35 is not provided. Meanwhile, FIG. 10 is a diagram schematically showing an exhaust flow rate in a case where the resonator 35 is provided to the exhaust pipe 16. In the drawings, a longer arrow shows a portion where the exhaust flow rate is faster. FIG. 9 and FIG. 10 show the exhaust flow rate distributions in the respective exhaust pipes 16.

As shown in FIG. 9, the exhaust flow rate is slow in a region corresponding to an inner circumference of the curve in the exhaust pipe 16 after the exhaust pipe 16 curves (right behind the curved pipe part 30) (region f1). When the communication hole 47 is set in communication with such a portion where the exhaust flow rate is slow, the influence on the exhaust flow due to the resonator 35 can be suppressed. Accordingly, in the present embodiment, the communication hole 47 is set in communication with the portion of the exhaust pipe 16 where the exhaust pipe 16 becomes a linear shape after curving and which is positioned on an extension side of the virtual extension line V1 of the curved portion of the exhaust pipe 16. As is apparent in comparison between FIG. 9 and FIG. 10, it can be seen that the influence on the exhaust flow due to provision of the resonator 35 is small (refer to a region f2 in FIG. 10). Note that, although only the single communication hole 47 is provided on the rear side in this embodiment, the influence on the exhaust flow can be suppressed in this configuration because the communication hole 47 is provided at the position distant from the curved pipe part 30 where the flow of the exhaust gas is likely to be disproportionate.

In addition, referring to FIG. 4 and FIG. 6 together, the resonator 35 in a top view has a front inclination portion 37F, which is closer to the cylinder 10 as the portion extends rearward, at a front-side corner portion thereof positioned on the cylinder 10 side. The resonator 35 in a top view also has a rear inclination portion 37R, which is positioned more distant from the cylinder 10 as the portion extends rearward, at a rear-side corner portion thereof positioned on the cylinder 10 side. The rear inclination portion 37R inclines more gently than the front inclination portion 37F and extends longer in the rearward direction (in the vehicle front-rear direction). In a case where this configuration is employed, the exhaust pipe 16 curves after extending forward, and then passes by a lateral side of the cylinder 10 in such a manner as to come closer to the cylinder 10 as the exhaust pipe 16 extends rearward in this embodiment. Thus, although the distance between the exhaust pipe 16 and the cylinder 10 is reduced as the exhaust pipe 16 extends rearward, the resonator 35 can be compactly arranged in the space S2 formed between the rear pipe part 31 and the cylinder 10 of the vehicle.

As described above, the resonator 35, which includes the communication hole 47 in communication with the exhaust pipe 16, is arranged in the space S2 between the exhaust pipe 16 and the cylinder 10 and is joined to the inwardly facing side surface of the exhaust pipe 16 in the motorcycle 1 according to the present embodiment. The motorcycle 1 includes the internal combustion engine 8, which includes the crankcase 9, the cylinder 10, and the cylinder head 11, is attached to the vehicle body frame 2, and the exhaust pipe 16 is connected to the cylinder head 11 and is curved after being extended forward and then is extended rearward in such a manner as to pass by the lateral side of the cylinder 10 above the crankcase 9. According to this configuration, it is possible to compactly arrange the resonator 35 while effectively using the space, thus improving the exterior arrangement of the vehicle.

In addition, in the present embodiment, the resonator 35 is formed in a flat box shape that is long in the vehicle front-rear direction and also in the vehicle up-down direction and has a small lateral width in the vehicle width direction. Moreover, the outer lateral wall 38 of the resonator 35 is directly joined to the exhaust pipe 16. According to this configuration, it is possible to reduce the vehicle width by effectively using the space S2 between the exhaust pipe 16 and the cylinder 10.

Furthermore, the resonator 35 is formed of the vertically divided two components in the present embodiment. According to this configuration, it is possible to form the resonator 35 separately between the exhaust pipe 16 side and the internal combustion engine 8 (cylinder 10) side and thus to match the portions of the resonator 35 with the shapes of the components on the respective sides, thereby, improving the degree of freedom in design.

Additionally, in the present embodiment, the exhaust protector 45 is provided to the exhaust pipe 16, and the first and second recessed portions 41 and 42, which respectively form the spaces S3 and S4 between the outer lateral wall 38 and the outer surface of the exhaust pipe 16, are formed on the outer lateral wall 38 of the resonator 35 facing the exhaust pipe 16. The exhaust protector 45 is placed opposite to the resonator 35 with the exhaust pipe 16 interposed therebetween and is supported by the band members 43 and 44, which are inserted through the first and second recessed portions 41 and 42, respectively. According to this configuration, the exhaust protector 45 can be simply installed without being affected by the resonator 35.

Moreover, in the present embodiment, the resonator 35 is attached to the rear pipe part 31 of the exhaust pipe 16 in such a manner as to straddle the joint portion 40 between the curved pipe part 30 and the rear pipe part 31 while causing the first recessed portion 41 to face the joint portion 40. According to this configuration, even if the exhaust pipe 16 is formed of divided components, the resonator 35 can be easily attached to the exhaust pipe 16.

In addition, in the present embodiment, the communication hole 47 of the resonator 35 is formed in such a manner as to be in communication with the portion of the exhaust pipe 16 where the exhaust pipe 16 becomes a linear shape after curving and which is positioned on an extension line of the curved portion of the exhaust pipe 16. According to this configuration, the communication hole 47 is formed at the portion of the exhaust pipe which is located at a position after the exhaust pipe curves and where the exhaust flow rate is slow. Thus, the influence on the exhaust flow due to the resonator 35 is suppressed, and a desired output of the internal combustion engine can be obtained.

Figure 11:
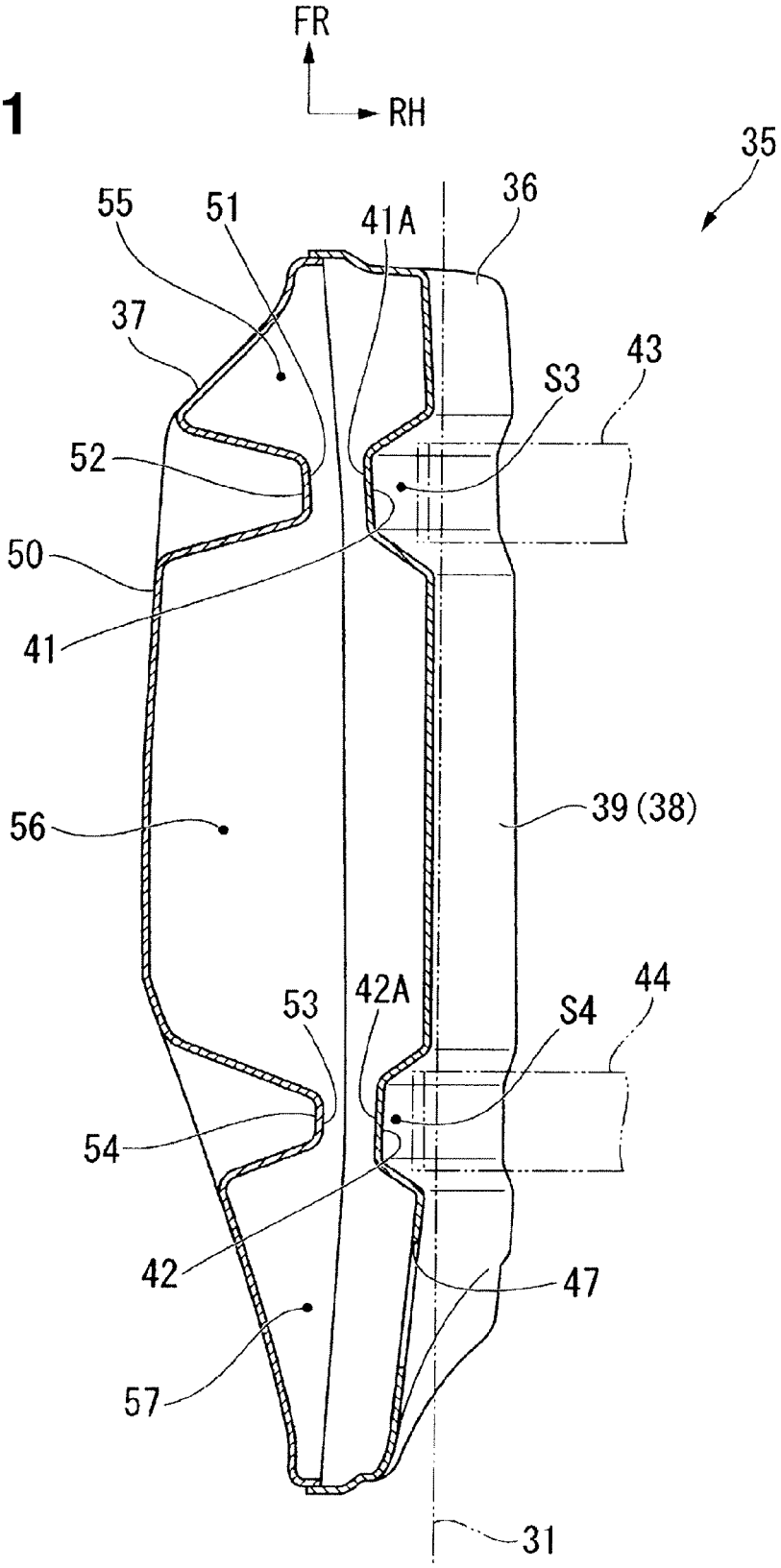
FIG. 11 is a view showing a cross section of a resonator according to a modification of the embodiment of the present invention.

Next, a description will be given of a modification of the aforementioned embodiment with reference to FIG. 11. In this modification, a front recessed portion 52 and a rear recessed portion 54 are formed on an inner lateral wall 50 of the inner half body 37 of the resonator 35 facing the cylinder 10. The front recessed portion 52 includes a bottom portion 51, which faces a bottom portion 41A of the first recessed portion 41. The first recessed portion 41 is formed on the outer lateral wall 38 on the inner portion of the resonator 35. The rear recessed portion 54 includes a bottom portion 53, which faces a bottom portion 42A of the second recessed portion 42.

Here, the bottom portion 41A of the first recessed portion 41 and the bottom portion 51 of the front recessed portion 52 face each other, and the bottom portion 42A of the second recessed portion 42 and the bottom portion 53 of the rear recessed portion 54 face each other in the resonator 35. Accordingly, three swell chambers 55, 56, and 57 in the order from the front are formed in the resonator 35. In a case where the configuration according to this modification is employed, it is possible to easily form the swell chambers in the resonator 35.

The embodiment of the present invention has been described above, but the present invention is not limited to the embodiment described above. For example, although the resonator 35 is formed as a half divided structure formed of the two components in the embodiment described above, the resonator 35 may be formed of a single box member.

Figure 12:
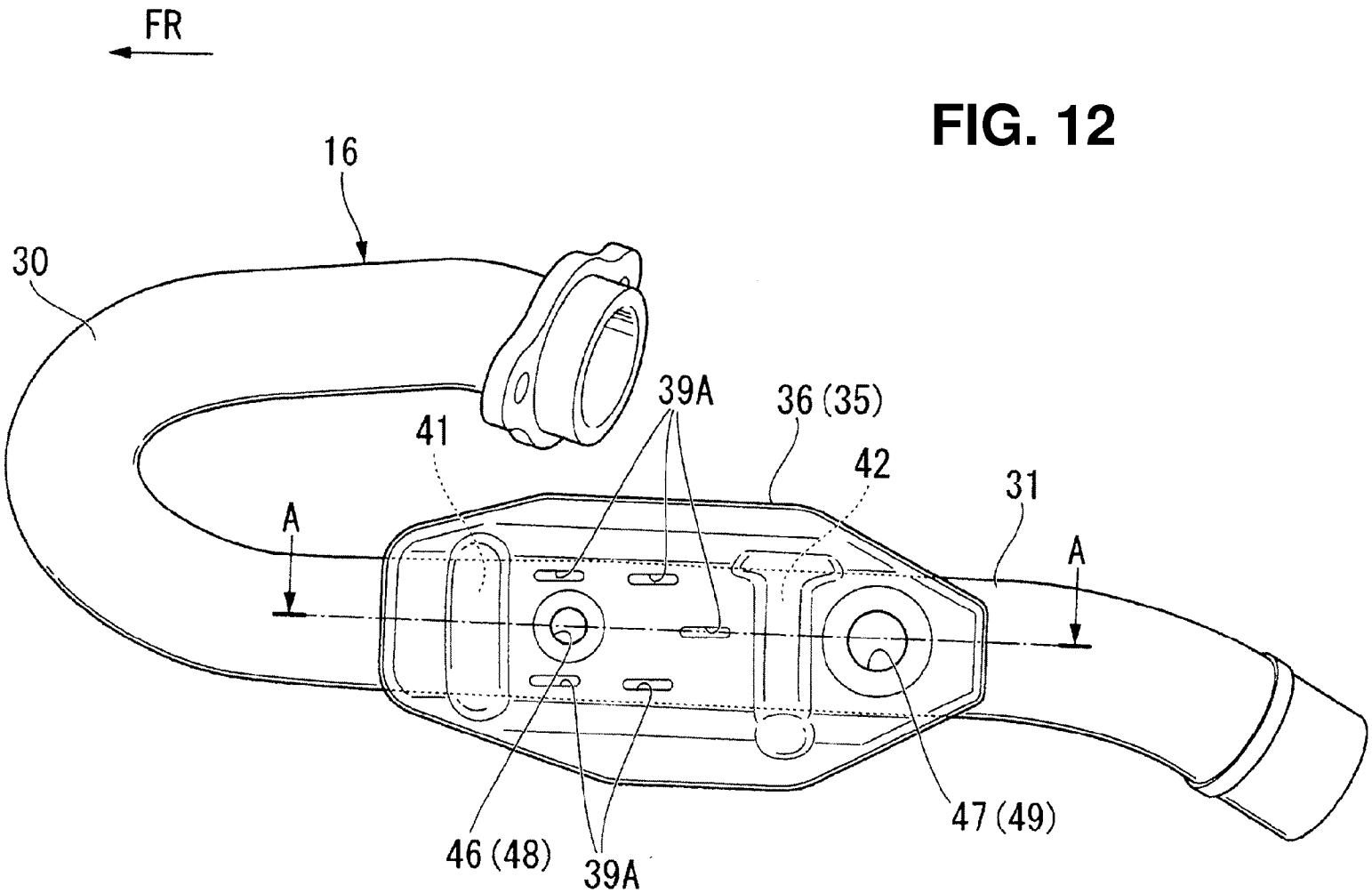
FIG. 12 is an inner perspective view of an exhaust pipe and a resonator similar to FIG. 7 but showing a modification of the embodiment of the present invention.

As another example, although the resonator 35 is set to be in communication with the exhaust pipe 16 through the single communication hole 47 in the embodiment described above, but multiple communication holes may be provided and may be formed at a position different from the position in the embodiment described above. As a specific example, a configuration in which a second communication hole 46 is added to the resonator 35 is shown in FIG. 12. In this example, the second communication hole 46 is formed separately from the communication hole 47 and is formed at a position near the rear of the first recessed portion 41. Then, a second through hole 48 corresponding to the second communication hole 46 is formed in the rear pipe part 31. In this configuration, the exhaust introduced into the resonator 35 through the communication hole 46 is returned to the exhaust pipe 16 after passing through the communication hole 47 and then is discharged.

Moreover, the following configuration is described in the embodiment described above. The exhaust protector 45 is supported by inserting the band members 43, 44 respectively through the first and second recessed portions 41 and 42, which are formed on the outer half body 36 of the resonator 35. However, the exhaust protector 45 may be supported by inserting the band member 43 or 44 through any one of the first and second recessed portions 41 and 42.

We claim:

1. A motorcycle exhaust system structure in a motorcycle in which an internal combustion engine including a crankcase, a cylinder, and a cylinder head is attached to a vehicle body frame, the motorcycle exhaust system structure comprising:

an exhaust pipe connected to the cylinder head;

an exhaust protector provided to the exhaust pipe; and a resonator having a lateral wall facing the exhaust pipe and a communication hole extending through the lateral wall and in communication with an inside of the exhaust pipe;

wherein:

the exhaust pipe is curved after being extended forward from the cylinder head and is then extended rearward in such a manner as to pass by a lateral side of the cylinder above the crankcase;

the resonator is arranged in a space between the exhaust pipe and the cylinder, and the lateral wall of the resonator is directly joined to a side surface of the exhaust pipe facing inwardly of the motorcycle;

a supporting recessed portion which forms a space between the resonator lateral wall and an outer surface of the exhaust pipe is formed in the resonator lateral wall;

the exhaust protector is placed on a side of the exhaust pipe opposite the resonator with the exhaust pipe interposed therebetween, and the exhaust protector is supported by a band member inserted through the supporting recessed portion.

2. The motorcycle exhaust system structure according to claim 1, wherein the resonator is formed of two components divided along a substantially vertical plane.

3. The motorcycle exhaust system structure according to claim 1, wherein the resonator has a flat box shape being long in a vehicle front-rear direction and a vehicle up-down direction and having a small lateral width in a vehicle width direction.

4. The motorcycle exhaust system structure according to claim 3, wherein the resonator is formed of two components divided along a substantially vertical plane.

5. The motorcycle exhaust system structure according to claim 3, wherein:

the exhaust pipe linearly extends rearward after curving; and the communication hole is in communication with a portion of the exhaust pipe where the exhaust pipe becomes a linear shape after curving and which is positioned on an extension line of a curved portion of the exhaust pipe.

6. The motorcycle exhaust system structure according to claim 3, wherein:

the exhaust pipe passes by the lateral side of the cylinder above the crankcase in such a manner as to come closer to the cylinder as extending rearward;

in a top view, the resonator includes a front inclination portion at a front-side corner portion thereof positioned facing the cylinder, and a rear inclination portion at a rear-side corner portion thereof positioned facing the cylinder, the front inclination portion coming closer to the cylinder as extending rearward, the rear inclination portion positioned more distant from the cylinder as extending rearward; and the rear inclination portion inclines more gently than the front inclination portion and is formed longer in the rearward direction.

7. The motorcycle exhaust system structure according to claim 1, wherein:

the exhaust pipe linearly extends rearward after curving; and the communication hole is in communication with a portion of the exhaust pipe where the exhaust pipe becomes a linear shape after curving and which is positioned on an extension line of a curved portion of the exhaust pipe.

8. The motorcycle exhaust system structure according to claim 1, wherein:

the exhaust pipe passes by the lateral side of the cylinder above the crankcase in such a manner as to come closer to the cylinder as extending rearward;

in a top view, the resonator includes a front inclination portion at a front-side corner portion thereof positioned facing the cylinder, and a rear inclination portion at a rear-side corner portion thereof positioned facing the cylinder, the front inclination portion coming closer to the cylinder as extending rearward, the rear inclination portion positioned more distant from the cylinder as extending rearward; and the rear inclination portion inclines more gently than the front inclination portion and is formed longer in the rearward direction.

9. The motorcycle exhaust system structure according to claim 1, wherein:

a recessed portion is formed in a lateral wall of the resonator facing the cylinder, the recessed portion having a bottom portion facing, inside the resonator, a bottom portion of the supporting recessed portion formed on the lateral wall of the resonator facing the exhaust pipe; and a swell chamber is formed in the resonator by the recessed portion facing the cylinder and the supporting recessed portion facing the exhaust pipe.

10. The motorcycle exhaust system structure according to claim 1, wherein:

the exhaust pipe is formed by joining together a curved pipe part extending forward from the cylinder head and then curving and a rear pipe part extending rearward from the curved pipe part;

a releasing recessed portion forming a space between the resonator lateral wall and an outer surface of the exhaust pipe is formed on the lateral wall of the resonator facing the exhaust pipe; and the resonator is attached to the exhaust pipe in such a manner as to straddle a joint portion of the exhaust pipe between the curved pipe part and the rear pipe part while causing the releasing recessed portion to face the joint portion.

11. The motorcycle exhaust system structure according to claim 10, wherein:

a recessed portion is formed in a lateral wall of the resonator facing the cylinder, the recessed portion having a bottom portion facing a bottom portion of the releasing recessed portion formed on the lateral wall of the resonator facing the exhaust pipe on an inner side of the resonator is formed on a lateral wall of the resonator facing the cylinder; and a swell chamber is formed in the resonator by the recessed portion facing the cylinder and the releasing recessed portion facing the exhaust pipe.

12. A motorcycle exhaust system structure in a motorcycle in which an internal combustion engine including a crankcase, a cylinder, and a cylinder head is attached to a vehicle body frame, the motorcycle exhaust system structure comprising:

an exhaust pipe connected to the cylinder head;

an exhaust protector provided to the exhaust pipe; and a resonator having a communication hole in communication with an inside of the exhaust pipe;

wherein:

the exhaust pipe is curved after being extended forward from the cylinder head and is then extended rearward in such a manner as to pass by a lateral side of the cylinder above the crankcase;

the resonator is arranged in a space between the exhaust pipe and the cylinder, and is joined to a side surface of the exhaust pipe facing inwardly of the motorcycle;

the exhaust protector is placed on a side of the exhaust pipe opposite to the resonator with the exhaust pipe interposed therebetween.

13. A motorcycle exhaust system structure in a motorcycle in which an internal combustion engine including a crankcase, a cylinder, and a cylinder head is attached to a vehicle body frame, the motorcycle exhaust system structure comprising:

an exhaust pipe connected to the cylinder head; and a resonator having a communication hole in communication with an inside of the exhaust pipe;

wherein:

the exhaust pipe is curved after being extended forward from the cylinder head and is then extended rearward in such a manner as to pass by a lateral side of the cylinder above the crankcase;

the resonator is arranged in a space between the exhaust pipe and the cylinder, is joined to a side surface of the exhaust pipe facing inwardly of the motorcycle and extends exclusively around a portion of the side of the exhaust pipe facing inwardly of the motorcycle.

* * * * *